United States Patent [19]

Schmidt

[11] Patent Number: 4,462,289

[45] Date of Patent: Jul. 31, 1984

[54] MATERIAL CUTTING APPARATUS FOR CUTTING SEGMENTS HAVING POINTED ENDS FROM A STRIP OF MATERIAL

[76] Inventor: Volker Schmidt, 4638 Todds Rd., Lexington, Ky. 40509

[21] Appl. No.: 418,755

[22] Filed: Sep. 16, 1982

[51] Int. Cl.[3] ..... B26D 5/22

[52] U.S. Cl. ..... 83/217; 83/80; 83/106; 83/559

[58] Field of Search ..... 83/105, 102, 106, 80, 83/209, 215-217, 556, 559

[56] References Cited

U.S. PATENT DOCUMENTS

| | | | |
|---|---|---|---|
| 2,197,043 | 4/1940 | Guyler | 83/215 |
| 2,920,521 | 1/1960 | Abbenante | 83/215 |
| 3,659,795 | 5/1972 | Bachi | 83/216 |
| 3,701,300 | 10/1972 | Schmidt et al. | 83/80 |
| 4,077,287 | 3/1978 | Makeev et al. | 83/215 |

*Primary Examiner*—James M. Meister
*Assistant Examiner*—John L. Knoble
*Attorney, Agent, or Firm*—Frank C. Leach, Jr.

[57] ABSTRACT

A vertically fed strip of material is cut into segments of selected lengths by a movable cutting knife cooperating with a fixed knife in which both of the knives are mounted in a frame for rotation between first and second cutting positions. When the knives are in the first cutting position, a segment is cut from the strip of material at a first angle other than orthogonal to the feed path. Rotation of the frame positions the cutting plane of the knives at a second angle to the first angle and other than orthogonal to the feed path to cut the segment, which is held prior to being cut at the first angle, to produce a pointed end.

16 Claims, 21 Drawing Figures

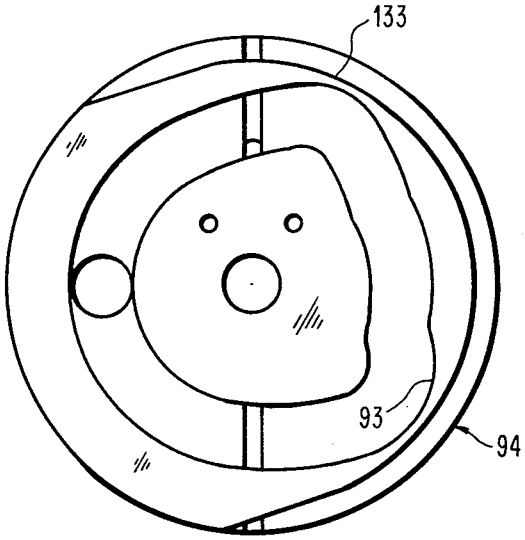
FIG. 6
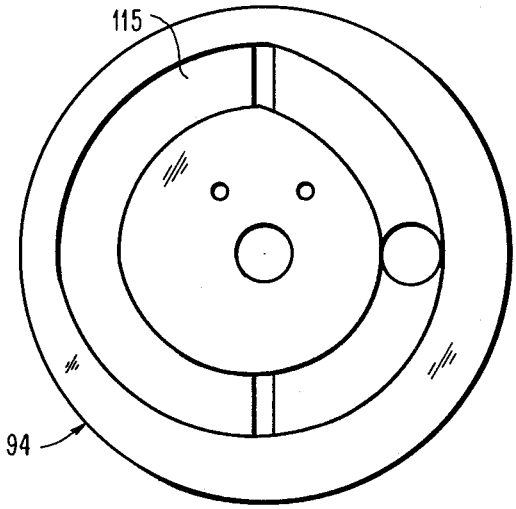
FIG. 7
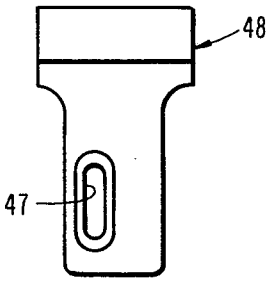
FIG. 10
FIG. 11
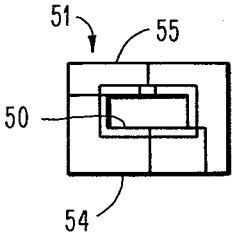

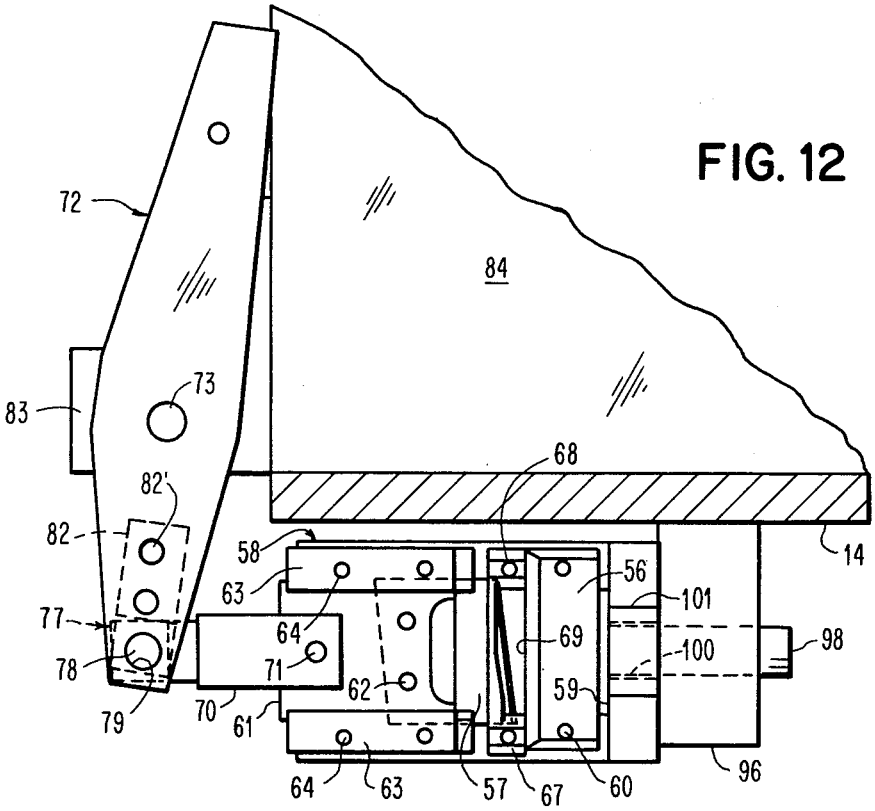
FIG. 12
FIG. 13
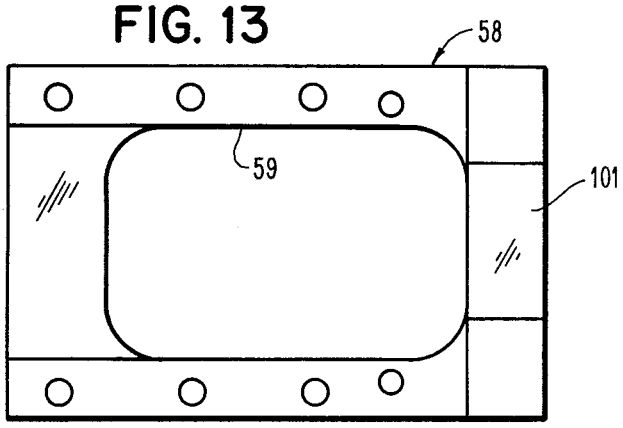
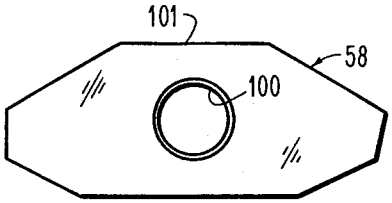
FIG. 15
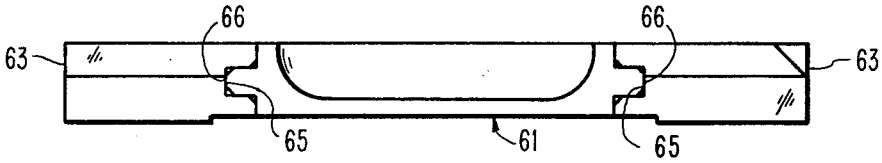
FIG. 14

MATERIAL CUTTING APPARATUS FOR CUTTING SEGMENTS HAVING POINTED ENDS FROM A STRIP OF MATERIAL

This invention relates to a material cutting apparatus and, more particularly, to a material cutting apparatus for cutting segments from a strip of material with each end being pointed.

In U.S. Pat. No. 3,701,300 to Schmidt et al, there is shown a material cutting apparatus in which a vertically fed strip of material is cut into segments of selected lengths by a horizontally movable knife or cutting blade. During each cycle of operation, the strip of material is fed to the cutting position and cut when the strip of material is not being fed. The horizontally movable cutting blade produced a cut segment with straight ends.

The material cutting apparatus of the aforesaid Schmidt et al patent has been improved to enable each end to be cut at an angle with the ends having the same angle or different angles or to enable one end to be straight and the other end to be at an angle. The cutting of a strip of material with each end being at alternate angles also has been suggested in U.S. Pat. No. 3,296,907 to Edelman in which there is a horizontal feed of a tape for cutting by a vertical movable cutting blade.

The material cutting apparatus for the aforesaid Schmidt et al patent has particular utility in cutting segments for use such as belt loops for pants, for example. The aforesaid Schmidt et al patent describes how a strip of material is formed to be later cut into smaller segments for use as belt loops for pants.

The material cutting apparatus of the present invention is an improvement of the cutting apparatus of the aforesaid Schmidt et al patent in that each end of the cut segment is pointed. This avoids fraying of the belt loop or other materials as can occur when the end is straight or at an angle.

To form the belt loop, each end of the cut segment must be tucked underneath the remainder of the cut segment prior to sewing the cut segment to the pants. If the operator of the sewing machine fails to properly align either tucked end, the possibility exists that a portion of the tucked end of the belt loop may be seen after being sewn to the pants. The belt loops produced from the segments cut by the material cutting apparatus of the present invention avoid this problem by forming each segment with pointed ends. This is because the pointed ends will not be visible when tucked beneath the remainder of the segment for sewing to the pants even if partially misaligned.

The material cutting apparatus of the present invention produces the cut segment with pointed ends through cutting the strip of material after means clamps the material to prevent it from leaving the cutting position in which it is initially cut at a first angle other than orthogonal to the feed path of the strip of material by cutting means disposed in a first cutting position. Then, the cutting means is rotated to a second cutting position in which it cuts the segment at a second angle to the first angle and at an angle other than orthogonal to the feed path. The cutting means is returned to its first cutting position after the second angle has been cut and the clamping means releases the clamped cut segment.

The material cutting apparatus of the present invention accomplishes this through using a single cam to control the rotation of the cutting means between its first and second cutting positions, the activation and inactivation of the clamping means, and the activation of the cutting means at each of its first and second cutting positions. This insures that each segment is cut with pointed ends.

An object of this invention is to provide a material cutting apparatus for cutting segments with pointed ends from a strip of material.

Other objects of this invention will be readily perceived from the following description, claims, and drawings.

This invention relates to a material cutting apparatus for cutting a strip of material into segments of a selected length with each segment having pointed ends including feed means to feed the strip of material past a cutting location and cutting means to cut the feed material at the cutting location into the segments. Controlling means controls the feed means and the cutting means to stop feed of the strip of material by the feed means before the cutting means cuts the strip of material to cut a segment of material and to start feed of the strip of material by the feed means after the cutting means has completed cutting the segment of material. Movable mounting means movably mounts the cutting means for movement between first and second cutting positions at the cutting location. First activating means activates the cutting means when the cutting means is in one of its first and second cutting positions to cut the strip of material at a first angle other than orthogonal to its feed path and activates the cutting means when the cutting means is in the other of its first and second positions to cut the strip of material at a second angle other than orthogonal to its feed path and to the first angle of the cut produced by the cutting means at the one position. Second activating means moves the cutting means between its first and second cutting positions to enable cutting of the strip of material at its first and second angles. Clamping means clamps the segment of material to be cut from the strip of material to hold the segment of material in position after it is cut by the cutting means when the cutting means is in the one position. Clamping control means renders the clamping means effective prior to the cutting means cutting the strip of material a first time when the cutting means is in the one position and renders the clamping means ineffective only after the cutting means has cut the strip of material a second time when the cutting means is in the other position.

The attached drawings illustrate a preferred embodiment of the invention, in which:

FIG. 6 is a side elevational view of one side of a cam of the apparatus of FIG. 1;

FIG. 7 is a side elevational view of the other side of the cam of FIG. 6;

Figure 21:
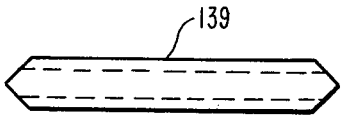
Figure 9:
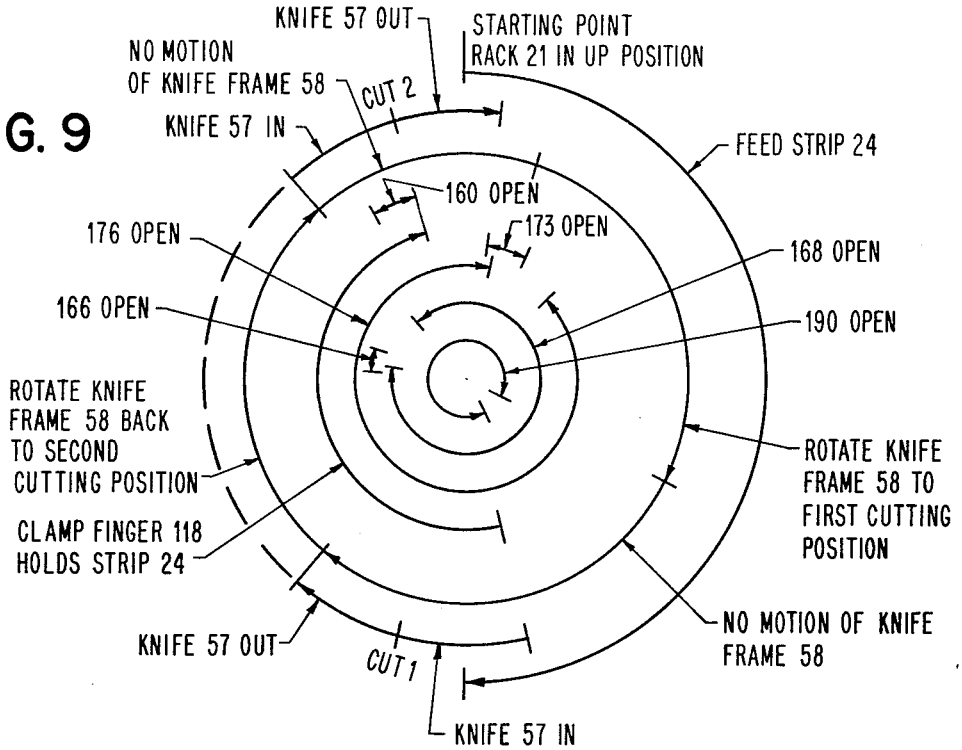
Figure 16:
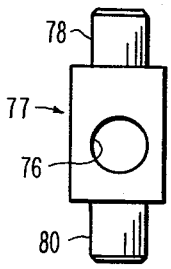
Figure 19:
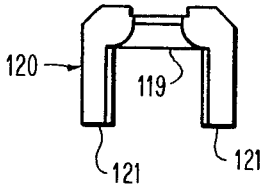
Figure 18:
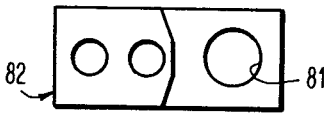
Figure 17:
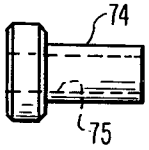
Figure 20:
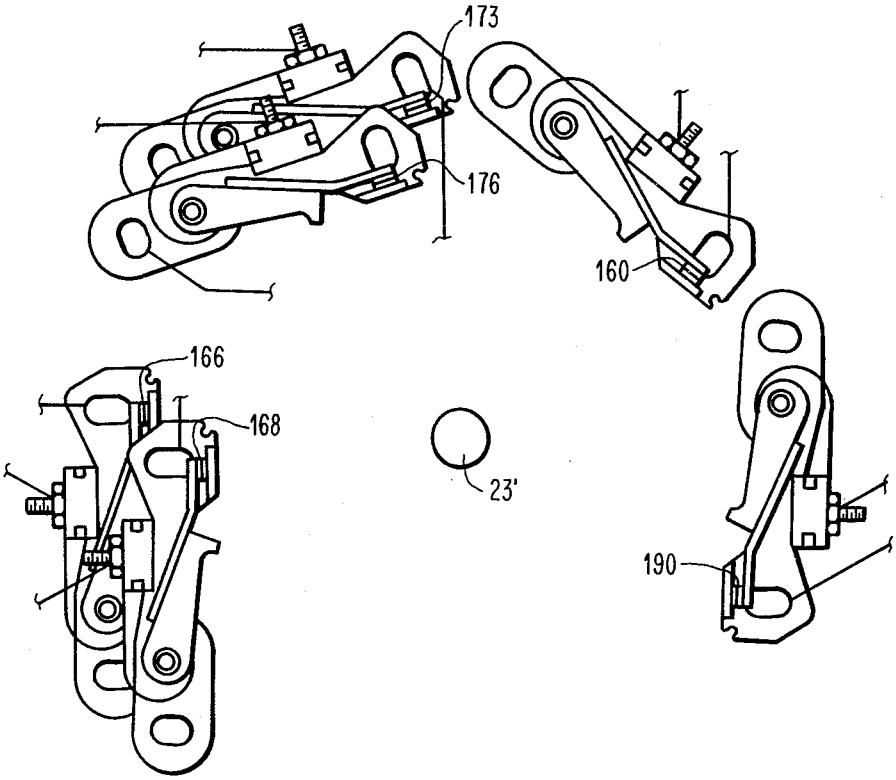

FIG. 9 is a schematic diagram showing the timing relation during a cycle of operation of the feeding of the strip of material to be cut, the rotation of the knife frame between the two cutting positions, the movement of the movable knife for cutting the strip of material, the holding of the strip of material when it is being cut, and the opening and closing of breaker contacts with the direction of rotation being taken from the rear of the apparatus and the 0° or start position being with the feed rack in its uppermost position;

FIG. 10 is a top plan view of a guide for the strip of material prior to the strip of material passing between feed rollers;

FIG. 11 is a bottom plan view of a guide for the strip of material beneath the feed rollers;

FIG. 12 is a top plan view of a knife frame, movable and stationary knives, and a knife arm for moving the movable knife relative to the stationary knife but not showing the mechanism for rotating the knife frame;

FIG. 13 is a top plan view of the knife frame;

FIG. 14 is an end elevational view of a slide on which the movable knife is mounted and showing the slide supported in slide rails;

FIG. 15 is an end elevational view of the knife frame taken from the opposite end of the knife frame to that having the movable knife mounted thereon;

FIG. 16 is a side elevational view of a trunnion connecting the movable knife to the knife arm;

FIG. 17 is a top plan view of a trunnion bushing used with the trunnion of FIG. 16;

FIG. 18 is a top plan view of a trunnion mount for supporting the lower end of the trunnion of FIG. 16;

FIG. 19 is a top plan view of a holder block against which the strip of material is held when it is cut;

FIG. 20 is a schematic view showing the arrangement of the breaker contacts relative to the shaft supporting the cams for operating the breaker contacts and taken from the rear of the apparatus; and FIG. 21 is a top plan view of a cut segment produced by the apparatus of the present invention.

Figure 1:
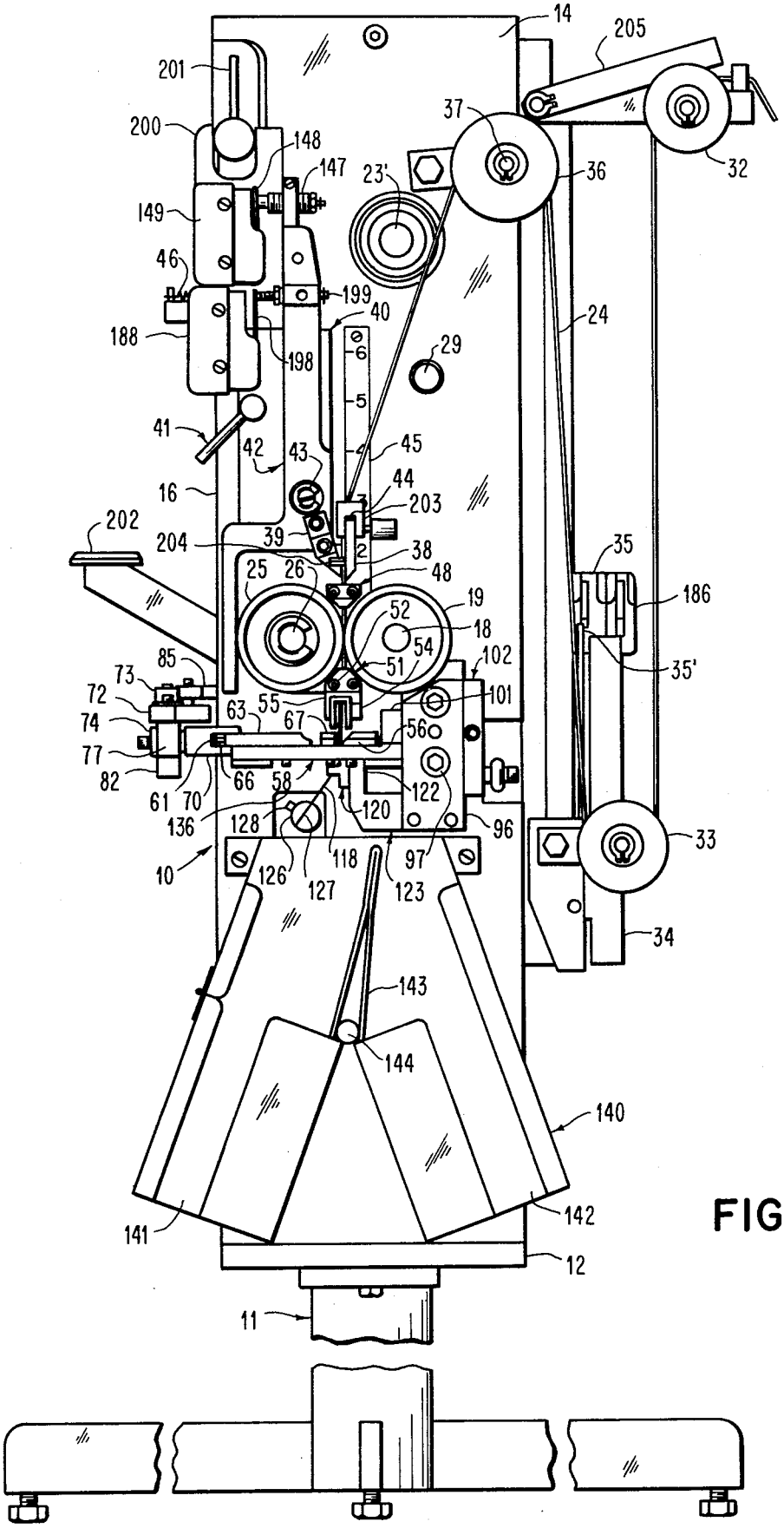
FIGS. 1 and 2 are a front elevational view of the material cutting apparatus of the present invention with the portion of the apparatus of FIG. 2 being disposed on top of the portion of the apparatus of FIG. 1.
Figure 2:
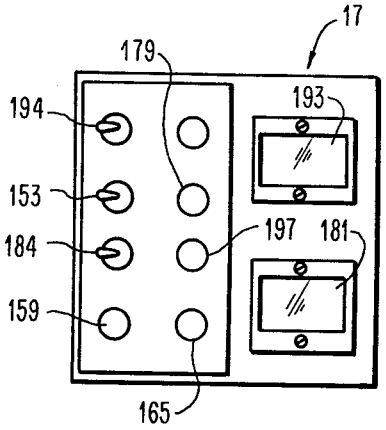

Referring to the drawings and particularly FIG. 1, there is shown a cutting apparatus of the present invention including a frame 10 supported on a stand 11. The frame 10 has a base 12, which is supported by the stand 11, and a pair of upstanding supports 14 and 15 (see FIGS. 4 and 5), which are spaced from each other and substantially parallel to each other. The support 14 has an inside cover 16 secured to its back surface. The upper ends of the supports 14 and 15 have a U-shaped member 17 (see FIG. 2) connected thereto.

A shaft 18 (see FIGS. 1, 4 and 5) is rotatably supported by the supports 14 and 15 and extends beyond each side thereof. A knurled roller 19 (see FIGS. 1 and 5), which is preferably formed of metal, is fixed to the front end of the shaft 18 for rotation therewith. Thus, whenever the shaft 18 is rotated, the knurled roller 19 is rotated.

Figure 3:
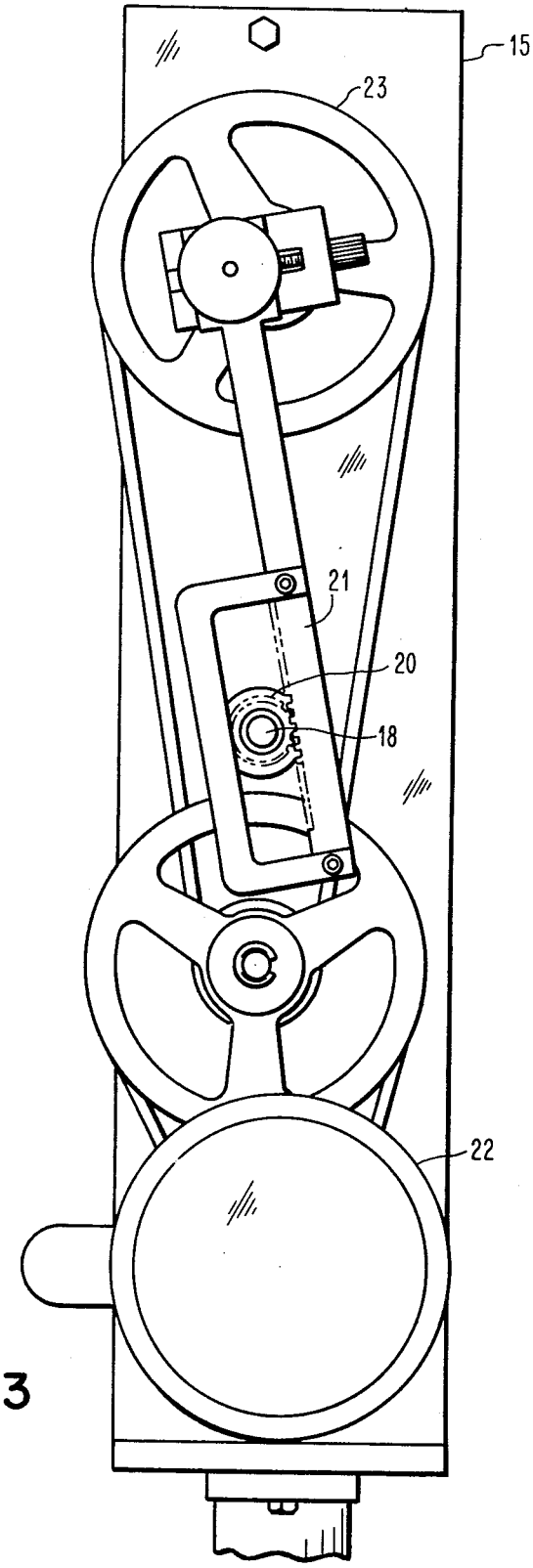
FIG. 3 is a rear elevational view of the portion of the apparatus of the present invention shown in FIG. 1.

The shaft 18 is rotatably supported in the supports 14 and 15 in the manner more particularly shown and described in the aforesaid Schmidt et al patent, which is incorporated by reference herein. Thus, the shaft 18 can be rotated in only one direction even though a gear 20 (see FIGS. 3 and 5) is driven in opposite directions by a cooperating rack 21 as more particularly shown and described in the aforesaid Schmidt et al patent.

The rack 21 is driven from a motor 22 (see FIG. 5) in the manner more particularly shown and described in the aforesaid Schmidt et al patent. As described in the aforesaid Schmidt et al patent, because of the one direction clutches (not shown), the shaft 18 is rotated only during 180° of each revolution of a pulley 23 (see FIG. 4), which is secured to one end of a shaft 23' rotatably mounted in the supports 14 and 15.

The rotation of the shaft 18 results in a strip 24 (see FIG. 1) of material being advanced due to the knurled roller 19 cooperating with a roller 25. The knurled roller 19 is rotated the same amount as the shaft 18.

As described in the aforesaid Schmidt et al patent, the amount of rotation of the knurled roller 19 during each revolution of the pulley 23 (see FIGS. 3 and 4) is adjustable in the manner shown and described in the aforesaid Schmidt et al patent. Therefore, the amount of feed of the strip 24 (see FIG. 1) of material during each revolution of the pulley 23 (see FIG. 3) can be selected to give a desired length of the strip 24 (see FIG. 1) of material that is to be cut.

The roller 25, which is preferably formed of steel, is rotatably mounted on one end of a stud 26, which extends through an enlarged opening (not shown) in the support 14 of the frame 10 in the manner shown and described in the aforesaid Schmidt et al patent.

The stud 26 has its other end fixed to the lower end of an arm 27 (see FIG. 5) of a lever 28. The lever 28 is pivotally mounted on a rod 29, which extends between the supports 14 and 15, by a hub 30 of the lever 28 and is resiliently biased by a spring 30' acting on the upper end of an arm 31 of the lever 28 in the manner more particularly shown and described in the aforesaid Schmidt et al patent. Accordingly, the roller 25 (see FIG. 1) is held in a very minute spaced relation to the knurled roller 19 to prevent any engagement therebetween, if there is no material therebetween, to prevent any damage to the roller 25 by the knurled roller 19, as more particularly shown and described in the aforesaid Schmidt et al patent.

The strip 24 of material is fed over a guide roller 32 and downwardly around a roller 33, which is rotatably mounted on a slidable block 34. When the strip 24 of material is prevented from being fed from a sewing machine (not shown) at which the various segments forming the strip 24 of material are sewed to each other, the roller 33 and the block 34 move upwardly a predetermined distance to open a switch 35 by a bar 35' movable with the block 34 to inactivate the motor 22 (see FIGS. 4 and 5) in the manner more particularly shown and described in the aforesaid Schmidt et al patent.

The strip 24 (see FIG. 1) of material passes upwardly from the roller 33 over a guide roller 36, which is rotatably mounted on a stud 37 fixed to the support 14 and extending therefrom. From the guide roller 36, the strip 24 of material passes downwardly between a meter plate 38 and a meter finger 39.

The meter plate 38 is secured to a meter base block 40, which is slidably mounted in the support 14. The meter base block 40 is retained in any position to which it is moved by a clamp lever 41. The relationship of the movement of the clamp lever 41 to the meter base block 40 is more particularly shown and described in the aforesaid Schmidt et al patent.

The meter finger 39 is fixed to a meter arm 42, which is pivorally mounted on a pivot pin 43 fixed to the meter base block 40. The meter finger 39 is constructed in the same manner as shown and described in the aforesaid Schmidt et al patent as is the meter plate 38.

In the manner more particularly shown and described in the aforesaid Schmidt et al patent, the positions of the meter plate 38 and the meter finger 39 relative to the rollers 19 and 25 are determined in accordance with the length of the strip 24 of material to be cut during each cycle. A top surface or edge 44 of the meter plate 38 cooperates with indicia on a scale 45, which is fixed to the support 14, to indicate the length of the strip 24 of material to be cut.

A spring 46, which has one end secured to the meter arm 42 and its other end connected to the meter base block 40, continuously urges the meter arm 42 counterclockwise (as viewed in FIG. 1) about the axis of the pivot pin 43. Thus, when the strip 24 of material is not fed between the meter plate 38 and the meter finger 39, the meter finger 39 is urged into engagement with the meter plate 38 by the spring 46.

Accordingly, when the strip 24 of material passes between the meter plate 38 and the meter finger 39, the meter arm 42 pivots clockwise about the axis of the pin 43 to accommodate the strip 24 of material. As the thickness of the strip 24 of material increases, a greater clockwise pivoting of the meter arm 42 occurs.

After the strip 24 of material passes between the meter plate 38 and the meter finger 39, the strip 24 of material passes through an opening 47 (see FIG. 10) in a guide 48, which is fixed to the support 14 (see FIG. 1), prior to passing between the rollers 19 and 25. After the strip 24 of material passes between the rollers 19 and 25, the strip 24 of material passes through an opening 50 (see FIG. 11) in a guide 51, which is attached by screws 52 (see FIG. 1) to a mounting block (not shown) secured by screws (not shown) to the support 14. The guide 51 (see FIG. 11) comprises two separate portions 54 and 55 with the opening 50 being formed between the two portions 54 and 55.

After passing through the guide opening 50, the strip 24 (see FIG. 1) of material passes between a stationary or fixed knife or cutting blade 56 (see FIG. 12) and a movable knife or cutting blade 57. The stationary knife or cutting blade 56 cooperates with the movable knife or cutting blade 57 to cut the strip 24 of material when the movable knife or cutting blade 57 is moved in a horizontal direction relative to the stationary knife or cutting blade 56. The stationary knife or cutting blade 56 is supported on the upper surface of a knife frame 58, which has a substantially rectangular shaped opening 59 (see FIG. 13) therein within which the movable knife or cutting blade 57 (see FIG. 12) slides. The stationary knife or cutting blade 56 is retained on the knife frame 58 by screws 60 and overlies a portion of the opening 59 (see FIG. 13) in the knife frame 58.

The movable knife or cutting blade 57 (see FIG. 12) is attached to the bottom surface of a slide 61 by screws 62. The slide 61 is slidably supported in a pair of slide rails 63, which are secured to the knife frame 58 on opposite sides of the opening 59 by screws 64. Each of the slide rails 63 has a groove 65 (see FIG. 14) therein to receive one of a pair of projecting guides 66 on the slide 61.

The knife frame 58 (see FIG. 12) has a guide 67 mounted on its upper surface and secured thereto by screws 68. The guide 67 cooperates with the adjacent edge of the stationary knife or cutting blade 56 to form a guide opening 69 through which the strip 24 (see FIG. 1) of material passes prior to being cut with the opening 69 (see FIG. 12) being aligned with a portion of the opening 59 (see FIG. 13) in the knife frame 58 and the opening 50 (see FIG. 11) in the guide 51.

The slide 61 (see FIG. 12) has one end attached to a clevis 70 by a screw 71. The clevis 70 has bifurcated portions, as shown in FIG. 1, forming a slot within which the slide 61 is disposed.

The clevis 70 is connected to a pivotally mounted knife arm 72 (see FIG. 12) to enable movement of the movable knife or cutting blade 57 towards and away from the stationary knife or cutting blade 56 by pivotal movement of the knife arm 72 about a pivot shaft 73. The clevis 70 is connected to the knife arm 72 so that the clevis 70 may rotate about an axis of rotation relative to the knife arm 72 to enable the knife frame 58 to be rotated about an axis between two different cutting positions with each of the cutting positions resulting in a cut at an angle other than orthogonal to the feed path of the strip 24 (see FIG. 1) of material.

The clevis 70 is connected to a trunnion bushing 74 (see FIG. 17) by a screw, which extends through a passage 75 in the trunnion bushing 74 and into a threaded recess (not shown) within the clevis 70 (see FIG. 12). The trunnion bushing 74 (see FIG. 17) is rotatably supported in a passage 76 (see FIG. 16) in a trunnion 77.

The trunnion 77 has an upper shaft 78 rotatably mounted in a passage 79 (see FIG. 12) in the knife arm 72 and a lower shaft 80 (see FIG. 16) rotatably supported in a passage 81 (see FIG. 18) in an L-shaped trunnion mount 82, which is secured to the knife arm 72 (see FIG. 12) by screws 82'. Therefore, the knife frame 58 can rotate about the vertical axis of the shafts 78 and 80 (see FIG. 16) of the trunnion 77 relative to the knife arm 72 (see FIG. 12).

Figure 4:
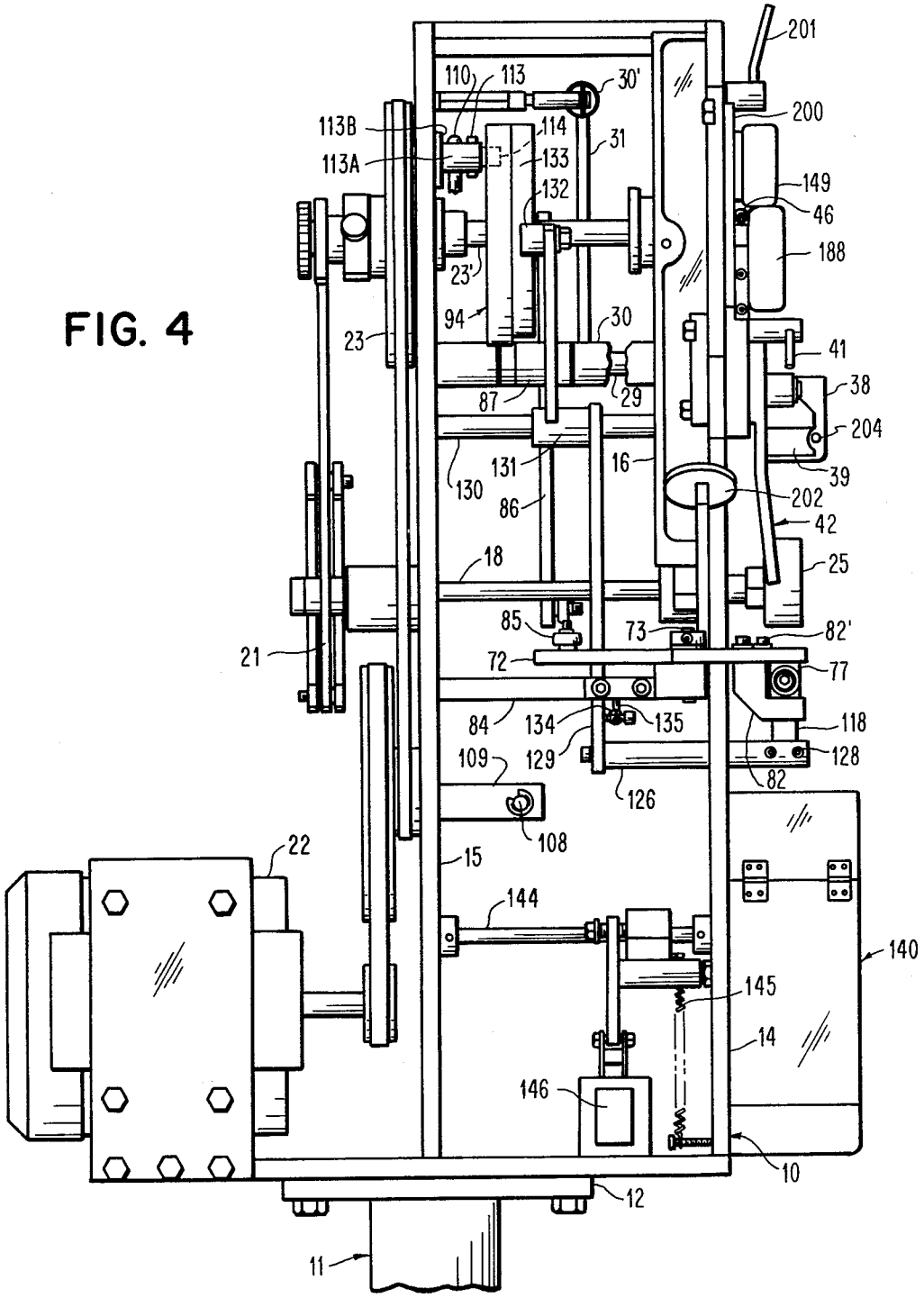
FIG. 4 is a side elevational view of a portion of the apparatus of the present invention shown in FIG. 1 with parts omitted for clarity purposes and taken from the left side thereof.

The knife arm 72 has the pivot shaft 73 secured to a mount 83, which is fixed to a plate 84 extending between the supports 14 and 15 (see FIG. 4). Thus, the knife arm 72 is pivotally supported by the supports 14 and 15. Accordingly, when the knife arm 72 is pivoted counterclockwise (as viewed in FIG. 12) about the pivot shaft 73, cutting of the strip 24 (see FIG. 1) of material occurs. The relationship of the stationary knife or cutting blade 56 to the movable knife or cutting blade 57 is the same as that more particularly shown and described in the aforesaid Schmidt et al patent.

The knife arm 72 is connected through a link 85 (see FIG. 4) to the lower end of a lever 86, which is pivotally mounted on the rod 29 by a hub 87 surrounding the rod 29. The link 85, which is pivotally connected to the knife arm 72 and the lever 86, causes the knife arm 72 to pivot about the pivot shaft 73 in response to pivoting of the lever 86 about the axis of the rod 29.

The lever 86 has a roller 92 (see FIG. 5), which functions as a cam follower, mounted on its upper end. The roller 92 functions as a cam follower by riding in a closed track 93 (see FIG. 6) on one side of a cam 94, which is secured to the shaft 23' (see FIG. 5).

Accordingly, the closed track 93 (see FIG. 6) of the cam 94 cooperates with the roller 92 (see FIG. 5) to move the lever 86 so that the knife arm 72 (see FIG. 12) is pivoted about the knife shaft 73 to move the movable knife or cutting blade 57 into cooperation with the stationary knife or cutting blade 56 to cut the strip 24 (see FIG. 1) of material. The profile of the closed track 93 (see FIG. 6) of the cam 94 is designed so that there are two different times during each revolution of the pulley 23 (see FIG. 3) at which the movable knife or cutting blade 57 (see FIG. 12) is moved into cooperation with the stationary knife or cutting blade 56 to cut the strip 24 (see FIG. 1) of material.

Accordingly, cutting of the strip 24 of material is coordinated with feeding of the strip 24 of material by driving of the roller 19. The cutting of the strip 24 of material either time during each revolution of the pulley 23 (see FIG. 3) does not occur until after feeding of the strip 24 (see FIG. 1) of material has been completed. Since feeding of the strip 24 of material ceases when downward movement of the rack 21 (see FIG. 3) stops as more particularly shown and described in the aforesaid Schmidt et al patent, the two cuttings of the strip 24 (see FIG. 1) of material occur during upward movement of the rack 21 (see FIG. 3).

In order that the two cuts of the strip 24 (see FIG. 1) of material during each revolution of the pulley 23 (see FIG. 3) occur at different angles so as to form each cut with pointed ends, it is necessary for the knife frame 58 (see FIG. 12) to rotate between the two cutting positions with each of these cutting positions being at an angle other than orthogonal to the feed path of the strip 24 (see FIG. 1) of material.

As previously mentioned, one end of the knife frame 58 (see FIG. 12) is rotatably supported by the knife arm 72. The other end of the knife frame 58 is rotatably supported in a bearing block 96, which is secured to the support 14 by screws 97 (see FIG. 1), through having a shaft 98 (see FIG. 12) supported in ball bearings (not shown) in the bearing block 96. The shaft 98 is threaded into a threaded opening 100 (see FIGS. 12 and 15) in an upstanding end portion 101 of the knife frame 58.

The shaft 98 (see FIG. 12) extends beyond the bearing block 96 and has a lever 102 (see FIG. 5) secured thereto. The lever 102 has a longitudinal slot 103 therein and within which is disposed a connecting pivotal pin 104 for pivotally connecting one end of a link 105 to the lever 102. The other end of the link 105 is pivotally connected by a pivot pin 106 to a pivotally mounted elbow 107, which is L-shaped. The location of the pin 104 within the slot 103 determines the amount of rotation in each direction of the shaft 98 so as to enable adjustment of the angle of each cut of the strip 24 (see FIG. 1) of material.

Figure 5:
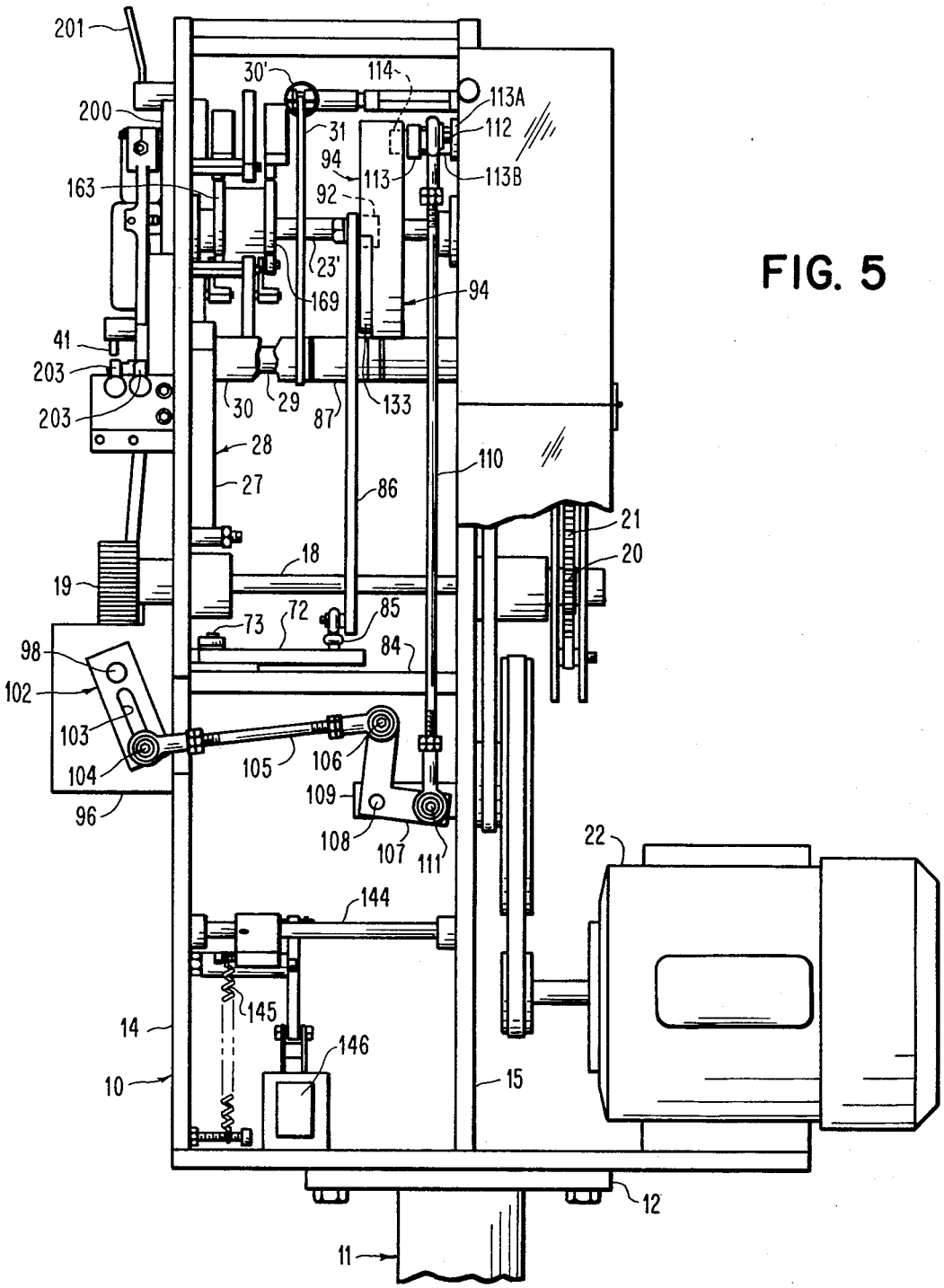
FIG. 5 is a side elevational view of a portion of the apparatus of the present invention shown in FIG. 1 with parts omitted for clarity purposes and taken from the right side thereof.

The elbow 107 is secured to one end of a rod 108, which is rotatably supported in a pair of spaced bearing blocks 109 (one shown in FIG. 5 and the other shown in FIG. 4). Each of the bearing blocks 109 is fixed to the support 15. Accordingly, the elbow 107 is mounted for pivotal movement by the rod 108.

The other end of the elbow 107 is pivotally connected to a lever 110 by a pivotal pin 111. The upper end of the lever 110 is connected by a pin 112 to a lever 113. The lever 113 has a hub 113A (see FIG. 4) at its end remote from the pin 112 (see FIG. 5) for rotatably supporting the lever 113 on a shaft (not shown) extending from a plate 113B (see FIG. 4) secured to the support 15. The lever 113 (see FIG. 5) extends away from the pin 112 and has a roller 114 mounted intermediate its ends for disposition within a closed track 115 (see FIG. 7) of the cam 94.

The closed track 115 is on the opposite side of the cam 94 from the closed track 93 (see FIG. 6). The profile of the closed track 115 (see FIG. 7) is such that the knife frame 58 (see FIG. 12) is rotated twice about its horizontal axis of rotation during each revolution of the pulley 23 (see FIG. 3). The rotation of the knife frame 58 (see FIG. 12) in one direction occurs during feeding of the strip 24 (see FIG. 1) of material past the knives or cutting blades 56 (see FIG. 12) and 57 while the rotation of the knife frame 58 in the opposite direction occurs after the first cut of the strip 24 (see FIG. 1) of material by moving the movable knife or cutting blade 57 (see FIG. 12) relative to the stationary knife or cutting blade 56 and prior to the second cut.

Prior to the strip 24 (see FIG. 1) of material being cut at the two angles other than orthogonal to its feed path during each cycle of operation, it is necessary to clamp the strip 24 of material beneath the cutting plane of the cutting blades 56 (see FIG. 12) and 57. The strip 24 (see FIG. 1) of material is clamped by a finger 118, which is formed of a suitable spring steel, moving the strip 24 of material against a substantially flat surface 119 (see FIG. 19) of a holder block 120, which has a pair of fingers 121 extending therefrom to have the finger 118 move therebetween and to function as a guide for the strip 24 (see FIG. 1) of material as it is advanced along its feed path prior to cutting of the strip 24 of material.

The holder block 120 is secured to an upstanding portion 122 of a mount 123, which is L-shaped, by a screw (not shown). The mount 123 is secured to the bearing block 96 by a screw (not shown).

The finger 118, which holds the segment of the strip 24 of material to be cut against the substantially flat surface 119 (see FIG. 19) of the holder block 120, is mounted in one end of a rod 126 (see FIG. 1) by being disposed in a slot 127 of the rod 126 and held therein by a pair of screws 128. The rod 126 has its other end secured to the bottom end of a lever 129 (see FIG. 4), which is pivotally mounted on a rod 130 by a hub 131 surrounding the rod 130. The rod 130 extends between the supports 14 and 15 below the rod 29.

The upper end of the lever 129 has a roller 132 mounted thereon and functioning as a cam follower. The roller 132 rides along a profile or cam track 133, which is formed on the same side of the cam 94 as the closed track 93 (see FIG. 6). Thus, the clamping of the segment of the strip 24 (see FIG. 1) of material to be cut is controlled from the cam 94 (see FIG. 6) on the same side thereof as controls the pivotal motion of the knife arm 72 (see FIG. 12) to cause cutting of the strip 24 (see FIG. 1) of material.

The roller 132 (see FIG. 4) is continuously biased into engagement with the cam profile or track 133 by a spring 134. One end of the spring 134 is connected to the lower end of the lever 129 while the other end of the spring 134 is secured to a connector 135 on the plate 84.

The rod 126 extends through an enlarged opening 136 (see FIG. 1) in the support 14 to enable motion of the rod 126 to position the finger 118 in clamping engagement with the strip 24 of material against the substantially flat surface 119 (see FIG. 19) of the holder block 120. The cam profile or track 133 (see FIG. 6) of the cam 94 causes the clamping by the finger 118 (see FIG. 1) to occur before there is cutting the first time of the strip 24 of material during a cycle of operation. This insures that the segment, which is severed from the strip 24 of material by the first cut, remains in position to have the second angular cut so that the cut segment has the pointed end. The finger 118 is released from holding the strip 24 of material against the substantially flat surface 119 (see FIG. 19) of the holder block 120 as soon as the second cut of the strip 24 (see FIG. 1) of material is completed.

After the finger 118 ceases to hold the cut segment of the strip 24 of material, the cut segment (One example shown at 139 in FIG. 21.) falls downwardly by gravity into a selector chute 140 (see FIG. 1), which has a pair of diverging passages 141 and 142. When a selector 143, which is fixed to a pin 144 for pivoting therewith, is in the position of FIG. 1, the cut segment of the strip 24 of material enters the passage 141 of the selector chute 140. The selector 143 is in the position of FIG. 1 when the thickness of the cut segment of the strip 24 of material does not exceed a predetermined thickness.

If the thickness of the cut segment of the strip 24 of material exceeds a predetermined thickness, then the selector 143 is disposed in the position in which the cut segment enters the passage 142 of the selector chute 140. This indicates that the cut segment is not satisfactory for use as a belt loop. The cut segments fall from the passage 141 into a container (not shown) while the cut segments fall from the passage 142 into a second container (not shown).

The selector 143 is retained in the position of FIG. 1 by a spring 145 (see FIGS. 4 and 5) in the manner more particularly shown and described in the aforesaid Schmidt et al patent. If the cut segment of the strip 24 of material exceeds the predetermined thickness, then a solenoid 146 is activated to pivot the selector 143 (see FIG. 1) in the manner more particularly shown and described in the aforesaid Schmidt et al patent to the position in which the selector 143 diverts the cut segment of the strip 24 of material into the passage 142 of the selector chute 140.

The thickness of the strip 24 of material is measured when it passes between the meter plate 38 and the meter finger 39. As previously mentioned, when the strip 24 of material passes between the meter plate 38 and the meter finger 39, the meter arm 42 pivots clockwise about the axis of the pivot pin 43. When the thickness of the strip 24 of material exceeds the predetermined thickness, an adjustment screw 147 on the upper end of the meter arm 42 is moved away from the position in which it engages a resiliently biased arm 148 of a microswitch 149. When the resiliently biased arm 148 is allowed to move sufficiently because of the movement of the adjustment screw 147 due to the thickened portion of the strip 24 of material passing between the meter plate 38 and the meter finger 39, the microswitch 149 closes.

The closing of the switch 149 produces a signal, which is stored by the electric circuit of the present invention until after the cutting portion of the cycle and then used to change the position of the selector 143, to indicate that the thickness of the measured portion of the strip 24 of material exceeds the predetermined thickness. This is because measuring of the thickness of the strip 24 of material by cooperation of the meter plate 38 and the meter finger 39 occurs during the feed portion of the prior cycle of operation to that in which cutting of the measured portion of the strip 24 of material occurs.

Figure 8:
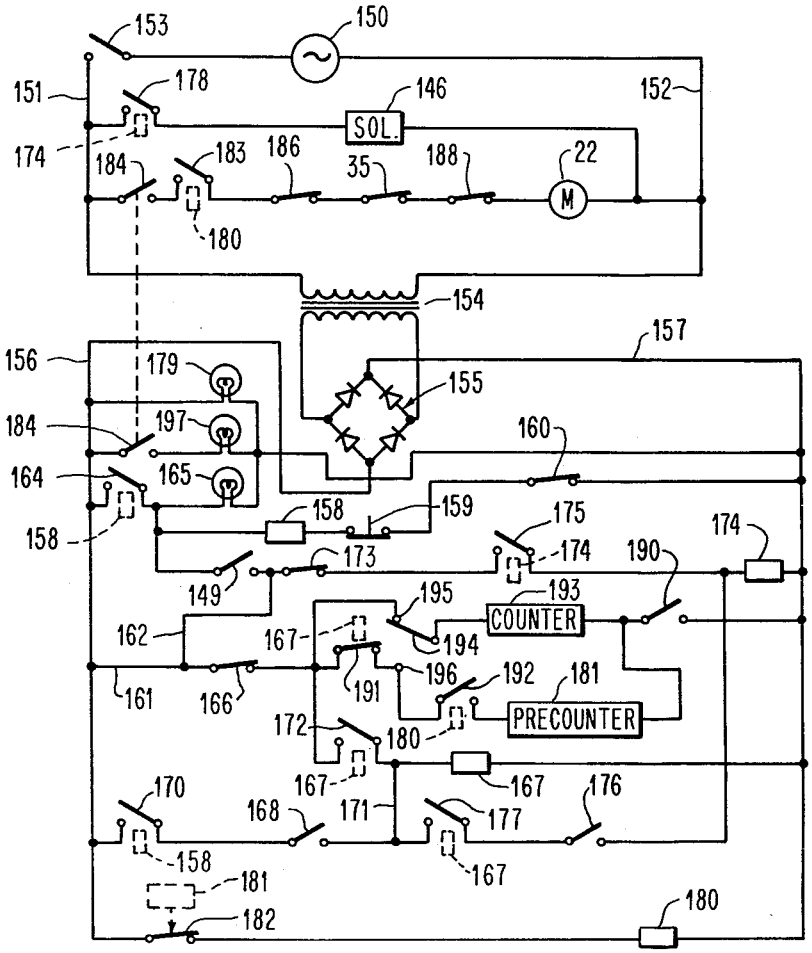
FIG. 8 is a schematic diagram of the electrical circuit used with the apparatus of FIG. 1.

Referring to FIG. 8, there is shown an electrical circuit of the present invention including an AC power source 150, which is connected to supply lines 151 and 152 through a switch 153. When the switch 153 is closed, a transformer 154 supplies a stepped down AC voltage, which is rectified by a Wheatstone bridge 155 to supply a DC voltage to lines 156 and 157.

Accordingly, when the switch 153 is closed, DC voltage is available between the lines 156 and 157. Thus, when the switch 149 is closed due to the measured portion of the strip 24 (see FIG. 1) of material being thicker than the predetermined thickness, a relay 158 (see FIG. 8) is energized if a push button 159, which is normally closed, is closed and normally closed breaker contacts 160 are closed. The breaker contacts 160, which are supported by the support 14 (see FIG. 1) and closed during most of a cycle of operation, as shown in FIG. 9, are closed during the feed portion of the cycle when measurement of the thickness of the strip 24 (see FIG. 1) of material is occurring. Accordingly, when the thickness of the strip 24 of material exceeds the predetermined thickness, a circuit is completed from the line 156 (see FIG. 8) through a line 161, a line 162, the closed switch 149, the relay 158, the closed push button 159, and the closed breaker contacts 160 to the line 157 to energize the relay 158.

The normally closed breaker contacts 160 are opened by a cam 163 (see FIG. 5), which is fixed to the shaft 23' for rotation therewith. The cam 163 has its profile designed to open the normally closed breaker contacts 160 (see FIG. 8) after the movable knife or cutting blade 57 (see FIG. 12) begins to move inwardly during its second cut of the strip 24 (see FIG. 1) of material and allows the breaker contacts 160 (see FIG. 8) to close again when the movable knife or cutting blade 57 (see FIG. 12) begins to move outwardly as shown in FIG. 9.

When the relay 158 (see FIG. 8) is activated, its normally open contact 164 is closed to provide a hold circuit for the relay 158 if the switch 149 opens due to the thickness of the strip 24 (see FIG. 1) of material no longer exceeding the predetermined thickness. This also continues energization of a lamp 165 (see FIG. 8), which was energized when the switch 149 closed, to indicate that the thickness of the strip 24 (see FIG. 1) of material has exceeded the predetermined thickness during the cycle of operation.

After completion of the feeding portion of the cycle of operation and the first cutting portion of the cycle of operation, normally closed breaker contacts 166 (see FIG. 8), which are supported by the support 14 (see FIG. 5), are opened by the cam 163. The opening of the breaker contacts 166 (see FIG. 8) inactivates a relay 167, which is the relay that stores the signal from closing of the switch 149 if the measured thickness of the strip 24 (see FIG. 1) of material exceeded the predetermined thickness, if the relay 167 (see FIG. 8) was energized during the prior cycle of operation. As shown in FIG. 9, the breaker contacts 166 open for a very short period of time but this is sufficient to remove any stored signal in the relay 167 (see FIG. 8) from the previous cycle of operation.

Shortly after the breaker contacts 166 are opened by the cam 163 (see FIG. 5), normally open breaker contacts 168 (see FIG. 8), which are supported by the support 14 (see FIG. 5), are closed by a cam 169, which also is fixed to the shaft 23' for rotation therewith. If the relay 158 (see FIG. 8) was energized during the feed portion of a cycle when the thickness of the strip 24 (see FIG. 1) of material was measured, then the relay 167 (see FIG. 8) is energized when the normally open breaker contacts 168 close since a normally open contact 170 of the relay 158 is closed to complete a circuit through the contact 170 of the relay 158, the breaker contacts 168, a line 171, and the relay 167.

Energization of the relay 167 closes its normally open contact 172 to provide a hold circuit for the relay 167 through the line 161, the normally closed breaker contacts 166, the contact 172 of the relay 167, and the relay 167. This hold circuit for the relay 167 is provided after the normally open breaker contacts 168 open shortly after closing as shown in FIG. 9 so that the relay 167 (see FIG. 8) remains activated during the next cycle of operation until the normally closed breaker contacts 166 open.

Shortly after the normally open breaker contacts 168 close, the cam 163 (see FIG. 5) opens the normally closed breaker contacts 160 (see FIG. 8). This inactivates the relay 158 and also turns off the lamp 165. As shown in FIG. 9, this is prior to the movable knife or cutting blade 57 (see FIG. 12) completing its second cut during a cycle of operation.

During the next cycle of operation, normally closed breaker contacts 173 (see FIG. 8) are opened by the cam 163 (see FIG. 5) in the initial portion of feeding the strip 24 (see FIG. 1) of material as shown in FIG. 9. If a relay 174 (see FIG. 8) is energized, the opening of the normally closed contacts 173 deenergizes the relay 174 by breaking its hold circuit, which includes the relay 174, a normally open contact 175 of the relay 174, the normally closed breaker contacts 173, the line 162, and the line 161. This deenergization of the relay 174 at the start of a cycle of operation enables the relay 174 to be activated if the thickness of the strip 24 (see FIG. 1) of material cut during the prior cycle of operation is greater than the predetermined thickness.

Therefore, shortly after the breaker contacts 173 open to inactivate the relay 174, the relay 174 is activated by the cam 169 (see FIG. 5) closing normally open breaker contacts 176 (see FIG. 8). The closing of the normally open breaker contacts 176 provides a circuit to energize the relay 174 from the line 156 to the line 157 through the line 161, the normally closed breaker contacts 166, the closed contact 172 of the relay 167, the line 171, a normally open contact 177 of the relay 167, the normally open breaker contacts 176, and the relay 174. This transfers the stored signal in the relay 167 from the prior cycle of operation to the relay 174.

Activation of the relay 174 closes its normally open contact 178 to energize the solenoid 146 to pivot the selector 143 (see FIG. 1) to the position in which it blocks the cut segment of the strip 24 of material from falling into the passage 141 of the selector chute 140 and diverts it into the passage 142 of the selector chute 140. The energization of the solenoid 146 (see FIG. 8) occurs after the cycle in which the thickness of the strip 24 (see FIG. 1) of material has been measured and during the feed portion of the next cycle in which the measured portion of the strip 24 of material will be cut.

Thus, the solenoid 146 (see FIG. 8) is energized to change the position of the selector 143 (see FIG. 1) after completion of cutting of the strip 24 of material. Of course, the measurement of the thickness of the strip 24 of material during the feed portion of a cycle is not that portion of the strip 24 of material that is cut after the feed portion of the same cycle but is that portion which will be cut after the feed portion of the next cycle. Therefore, the selector 143 is properly positioned to be ready for the next cut segment of the strip 24 of material.

The normally open breaker contacts 176 (see FIG. 8) remain closed a substantial period after the breaker contacts 173 open as shown in FIG. 9. This insures that the relay 174 (see FIG. 8) is energized when the relay 167 has been energized in the prior cycle due to the thickness of the strip 24 (see FIG. 1) of material exceeding the predetermined thickness.

A lamp 179 (see FIG. 8), which extends between the lines 156 and 157, is activated whenever the switch 153 is closed. Thus, the lamp 179 indicates whenever the power source 150 is connected to the supply line 151 and 152.

A relay 180 is energized whenever a precounter 181, which counts down to zero by a count of one for each satisfactory cut segment, is set at a count other than zero so that a switch 182 of the precounter 181 is closed. One suitable example of the precounter 181 is a Veeder/Root series 7441 predetermining counter.

The relay 180 has a normally open contact 183 in series with the motor 22. Thus, the motor 22 cannot be activated by closing of a manual switch 184 unless the precounter 181 has been set to a selected count. This insures that the motor 22 only operates when the precounter 181 has been set to a count which represents the desired number of satisfactory cut segments of the strip 24 (see FIG. 1) of material to be produced.

The motor 22 (see FIG. 8) can be activated only by closing of the manual switch 184 with the normally open contact 183 of the relay 180 closed because of the precounter 181 not being set at a count of zero so that the relay 180 is activated. Furthermore, the switch 35 and switches 186 and 188 also must be closed.

As previously mentioned, the switch 35, which is a two-way roller microswitch, is closed unless the roller 33 (see FIG. 1) is pulled up sufficiently by the strip 24 of material. The switch 186, which is a one-way roller microswitch, is closed unless the roller 33 is moved up sufficiently to open the switch 35. If this occurs, then the switch 186 is opened on downward movement of the block 34 and does not close until the block 34 reaches its lowermost position. The switch 188 is closed unless a supply of the strip 24 of material is exhausted.

The precounter 181 (see FIG. 8) counts down by a count of one each time that normally open breaker contacts 190 are closed by the cam 169 (see FIG. 5). As shown in FIG. 9, this occurs during the feed portion of each cycle of operation.

The precounter 181 (see FIG. 8) does not count down by a count of one whenever the cut segment of the strip 24 (see FIG. 1) of material exceeds the predetermined thickness. This is because a normally closed contact 191 (see FIG. 8) of the relay 167 opens when the cut segment of the strip 24 (see FIG. 1) of material exceeds the predetermined thickness to cause the relay 167 (see FIG. 8) to be activated.

The precounter 181 is connected to the normally closed contact 191 of the relay 167 through a normally open contact 192 of the relay 180. This insures that the precounter 181 does not continue to count after the count goes to zero as the next count would cause the precounter 181 to be set at its maximum count.

A counter 193 also is connected to the normally open breaker contacts 190 so that the counter 193 has its count increased by the count of one each time that the normally open breaker contacts 190 close if a switch 194 is engaging a contact 195 as shown in FIG. 8 in which the switch 194 bypasses the normally closed contact 191 of the relay 167. However, if the switch 194 is in engagement with a contact 196, then the counter 193 has its circuit interrupted when the relay 167 is energized so that the counter 193 only counts the usable cut segments and not all cut segments as occurs when the switch 194 engages the contact 195. Therefore, the position of the switch 194 determines whether the counter 193 counts all of the cut segments or only the satisfactory cut segments. One suitable example of the counter 193 is a Veeder/Root series 7440 counter.

When the switch 184 is closed, a lamp 197 is energized. This indicates that the switch 184 for the motor 22 is closed even though the motor 22 may not be activated because of one of the switches 35, 186, and 188 being open or the contact 183 of the relay 180 being open because of the relay 180 not being energized due to the precounter 181 being at a count of zero.

The switch 188 is a microswitch, which is supported on the meter base block 40 (see FIG. 1). The switch 188 has a resiliently biased arm 198, which is engaged by an adjustment screw 199 on the meter arm 42 between the adjustment screw 147 and the pivot pin 43.

The adjustment screw 199 moves the arm 198 of the switch 188 inwardly to inactivate the motor 22 (see FIG. 8) by opening the switch 188 only when there is no material between the meter plate 38 (see FIG. 1) and the meter finger 39 whereby the meter arm 42 pivots counterclockwise (as viewed in FIG. 1) about the pin 43. This insures that there is automatic cut off of the motor 22 (see FIG. 8) whenever the strip 24 (see FIG. 1) of material ceases to be fed and the end of the strip 24 of material is not held with the sewing machine.

Even if the motor 22 (see FIG. 8) becomes inactivated due to the opening of any of the switches 35, 184, 186 and 188 or the contact 183 of the relay 180, the relay 167 remains energized because it is connected to the line 156 and 157. Therefore, the signal stored by energization of the relay 167 remains even if the operator opens the manual motor switch 184 when the operator leaves the apparatus of the present invention for a period of time. Of course, if the switch 153 is opened, then the stored memory is lost.

The microswitch 149 is supported on a mounting base 200 (see FIG. 1), which is pivotally mounted at its lower end on the meter back block 40 by a pivot pin (not shown) in the manner more particularly shown and described in the aforesaid Schmidt et al patent. Thus, the microswitch 149 may be moved toward and away from the adjustment screw 147 through pivoting the mounting base 200 by rotating an adjustment lever 201. The adjustment lever 201 is mounted in the manner more particularly shown and described in the aforesaid Schmidt et al patent.

When it is desired to move the roller 25 away from the knurled roller 19 to manually feed the strip 24 of material therebetween at the start, it also is necessary to move the meter finger 39 away from the meter plate 38. Movement of both of these occurs at the same time by pushing downwardly on a pivotally mounted lever 202 in the manner more particularly shown and described in the aforesaid Schmidt et al patent.

While the top surface 44 of the meter base plate 38 functions as a mark for cooperation with indicia on the scale 45 to indicate the length of the strip 24 of material that is to be fed during each cycle, control of the amount of feed of the strip 24 of material during each revolution of the pulley 23 (see FIG. 3) is in the manner more particularly shown and described in the aforesaid Schmidt et al patent.

The position of the switch 149 (see FIG. 1) relative to the meter arm 42 must be adjusted for the particular thickness of the strip 24 of material being fed. Accordingly, it is necessary to make certain adjustments when the strip 24 of material is changed so as to have a different thickness. These adjustments are made in the manner shown and described in the aforesaid Schmidt et al patent.

Considering the operation of the apparatus of the present invention after the various adjustments have been made, the strip 24 of material is passed over the roller 32 downwardly around the roller 33, upwardly over the guide roller 36, downwardly between a pair of spaced guides 203 on the upper portion of the meter plate 38 and then between a pair of spaced pins 204 (one shown in FIGS. 1 and 4 and both shown and described in the aforesaid Schmidt et al patent) on the meter plate 38 with the meter finger 39 held away from the meter plate 38 by downward depression of the lever 202, through the opening 47 (see FIG. 10) in the guide 48, and between the roller 19 (see FIG. 1) and the roller 25 into the opening 50 (see FIG. 11) in the guide 51. The lever 202 (see FIG. 1) is released when a pivotally mounted drag arm 205 is disposed on top of the portion of the strip 24 of material passing over the roller 32.

To begin operation, the operator must close the switch 153 (see FIG. 8) and the motor switch 184 with the count of the precounter 181 set at a count other than zero. The motor 22 rotates the pulley 23 (see FIG. 3) to drive the feed roller 19 (see FIG. 1) through the rack 21 (see FIG. 3) engaging the gear 20 on the shaft 18. During the first 180° of each revolution of the pulley 23, the strip 24 (see FIG. 1) of material is fed for the selected distance by rotation of the roller 19 in the manner more particularly shown and described in the aforesaid Schmidt et al patent. This 180° of rotation of the pulley 23 (see FIG. 3) feeds the strip 24 (see FIG. 1) of material as shown in FIG. 9.

During about 99° of revolution of the pulley 23 (see FIG. 3) during the feed portion of the cycle, the knife frame 58 (see FIG. 12) is rotated to its first cutting position by the roller 114 (see FIG. 5) riding in the closed track 115 (see FIG. 7) of the cam 94 rotating with the shaft 23' (see FIG. 5) on which the cam 94 is mounted. This is completed when the pulley 23 (see FIG. 3) has been rotated approximately 117° from the start of the cycle as shown in FIG. 9.

Prior to the completion of the feed portion of the cycle of operation, inward movement of the movable knife or cutting blade 57 (see FIG. 12) towards the stationary knife or cutting blade 56 to cut the strip 24 (see FIG. 1) of material begins by the roller 92 (see FIG. 5) riding in the closed track 93 (see FIG. 6) of the cam 94 rotating with the shaft 23' (see FIG. 5) on which the cam 94 is mounted. However, cutting of the strip 24 (see FIG. 1) of material does not occur until after feeding of the strip 24 of material has been completed with this being controlled by the profile of the closed track 93 (see FIG. 6) of the cam 94.

At the same time that inward movement of the movable knife or cutting blade 57 (see FIG. 12) begins with the knife frame 58 in its first cutting position, the clamp finger 118 (see FIG. 1) is moved to hold the strip 24 of material against the substantially flat surface 119 (see FIG. 19) of the holder block 120. The movement of the clamp finger 118 (see FIG. 1) is controlled by the roller 132 (see FIG. 4) riding on the cam profile or track 33 (see FIG. 6) of the cam 94 rotating with the shaft 23' (see FIG. 4) on which the cam 94 is mounted.

While this movement of the clamp finger 118 (see FIG. 1) occurs before feeding of the strip 24 of material is completed, the feeding of the strip 24 of material is a harmonic type of motion in that there is deceleration as the rack 21 (see FIG. 3) completes its downward movement as discussed in the aforesaid Schmidt et al patent. Thus, there is a minute, if any, feeding of the strip 24 (see FIG. 1) of material at the time that the finger 118 moves the strip 24 of material against the substantially flat surface 119 (see FIG. 19) of the holder block 120. This occurs at about 171° of revolution of the pulley 23 (see FIG. 3) as shown in FIG. 9.

When the movable knife or cutting blade 57 (see FIG. 12) completes its inward movement to complete cutting of the strip 24 (see FIG. 1) of material, outward movement of the movable knife or cutting blade 57 (see FIG. 12) begins by the roller 92 (see FIG. 5) riding in the closed track 93 (see FIG. 6) of the cam 94 rotating with the shaft 23' (see FIG. 5) on which the cam 94 is mounted. This outward movement of the knife or cutting blade 57 (see FIG. 12) begins at about 201' of rotation of the pulley 23 (see FIG. 3) and ends at approximately 220° as shown in FIG. 9.

When outward movement of the movable knife or cutting blade 57 (see FIG. 12) is completed, rotation of the knife frame 58 to the second cutting position begins with this movement being produced by the roller 114 (see FIG. 5) riding in the closed track 115 (see FIG. 7) of the cam 94 rotating with the shaft 23' (see FIG. 5) on which the cam 94 is mounted. This rotation of the knife frame 58 (see FIG. 12) to the second cutting position is completed at about 318° of rotation of the pulley 23 (see FIG. 3) as shown in FIG. 9.

When rotation of the knife frame 58 (see FIG. 12) to the second cutting position is completed, inward movement of the movable knife or cutting blade 57 is initiated by the roller 92 (see FIG. 5) riding in the closed track 93 (see FIG. 6) of the cam 94 rotating with the shaft 23' (see FIG. 5) on which the cam 94 is mounted. As shown in FIG. 9, this inward movement of the movable knife or cutting blade 57 (see FIG. 12) begins at approximately 318° of rotation of the pulley 23 (see FIG. 3) with the cutting being completed at about 346' of rotation of the pulley 23 at which the movable knife or cutting blade 57 (see FIG. 12) begins to move outwardly. This outward movement of the movable knife or cutting blade 57 is completed at approximately 8° of the next cycle of revolution of the pulley 23 (see FIG. 3) as shown in FIG. 9.

As soon as the movable knife or cutting blade 57 (see FIG. 12) starts to move out, the clamp finger 118 (see FIG. 1) ceases to hold the strip 24 of material against the substantially flat surface 119 (see FIG. 19) of the holder block 120. The movement of the clamp finger 118 (see FIG. 1) is controlled by the roller 132 (see FIG. 4) riding on the cam profile or track 133 of the cam 94 rotating with the shaft 23' on which the cam 94 is mounted.

If any portion of the strip 24 (see FIG. 1) of material passing between the meter plate 38 and the meter finger 39 during the feed portion of the cycle is thicker than the predetermined thickness, then the relay 158 (see FIG. 8) would have been energized during the feed portion of the cycle of operation. The cams 163 (see FIG. 5) and 169 cooperate with the breaker contacts 160 (see FIG. 8), 166, 173, 168, and 176 to transfer the signal from the relay 158 to the relay 167 and then to the relay 174. This transfer of the signal to the relay 174 causes the solenoid 146 to be energized because the normally open contact 178 of the relay 174 is closed. Thus, the selector 143 (see FIG. 1) is pivoted counterclockwise (as viewed in FIG. 1) about the axis of the pin 144. This does not occur until the feed portion of the cycle of operation in which the thicknened portion of the strip 24 of material is to be cut.

Thus, as shown in FIG. 9, the normally closed breaker contacts 166 (see FIG. 8) are opened by the cam 163 (see FIG. 5) at about 279° of rotation of the pulley 23 (see FIG. 3) to inactivate the relay 167 (see FIG. 8) to clear any signal from the prior cycle. At approximately 281° of revolution of the pulley 23 (see FIG. 3), the cam 169 (see FIG. 5) closes the normally open breaker contacts 168 (see FIG. 8) to energize the relay 167 if the relay 158 has been activated during the feed portion of the cycle because the normally open contact 170 of the relay 158 is now closed. The breaker contacts 166 are closed at about 294° of rotation of the pulley 23 (see FIG. 3) as shown in FIG. 9. This insures that the hold circuit is present for the relay 167 (see FIG. 8), if the relay 167 is to be energized, prior to the breaker contacts 168 returning to their open position at approximately 318° of rotation of the pulley 23 (see FIG. 3). This is the same time that the movable knife or cutting blade 57 (see FIG. 12) begins inward movement as shown in FIG. 9.

After the signal is transferred from the relay 158 (see FIG. 8) to the relay 167, the breaker contacts 160 open at about 330° of rotation of the pulley 23 (see FIG. 3) to deenergize the relay 158 (see FIG. 8). The breaker contacts 160 close at the same time as the movable knife or cutting blade 57 (see FIG. 12) begins its outward movement; as shown in FIG. 9, this is at approximately 346° of rotation of the pulley 23 (see FIG. 3). Thus, the relay 158 (see FIG. 8) is ready to be energized if the strip 24 (see FIG. 1) of material again exceeds the predetermined thickness during any portion of the next feed cycle.

The signal is not transferred from the relay 167 (see FIG. 8) to the relay 174 until the feed portion of the next cycle (This is the cycle in which the thickened portion is to be cut.). Prior to transferring the signal from the relay 167 to the relay 174, the breaker contacts 173 are opened at about 8° of revolution of the pulley 23 (see FIG. 3) to deenergize the relay 174 (see FIG. 8) if it had been energized during the prior cycle; this is the same time as when the movable knife or cutting blade 57 (see FIG. 12) completes its outward movement as shown in FIG. 9. Shortly thereafter at about 10° of rotation of the pulley 23 (see FIG. 3), the breaker contacts 176 (see FIG. 8) close to transfer the signal from the relay 167 to the relay 174. The breaker contacts 173 close at about 21° of rotation of the pulley 23 (see FIG. 3) while the breaker contacts 176 (see FIG. 8) do not open until about 47° of rotation of the pulley 23 (see FIG. 3) as shown in FIG. 9.

The precounter 181 (see FIG. 8) is counted down by a count of one each time that the breaker contacts 190 close at about 120° of rotation of the pulley 23 (see FIG. 3) as shown in FIG. 9. The breaker contacts 190 (see FIG. 8) open at about 167° of rotation of the pulley 23 (see FIG. 3) as shown in FIG. 9. Accordingly, the precounter 181 (see FIG. 8) is counted down during the feed portion of the cycle. Because of the momentum of the motor 22, the cycle of operation is completed even though the motor 22 is turned off when the precounter 181 goes to a count of zero during the feed portion of the cycle whereby the contact 183 of the relay 180 opens.

Thus, the apparatus of the present invention functions automatically to continue to feed, cut, and determine the position of the selector 143 (see FIG. 1) during the next cycle as long as the precounter 181 (see FIG. 8) is at a count other than zero and the strip 24 (see FIG. 1) of material is fed. If the strip 24 of material should be held in the sewing machine at which the segments, which form the strip 24 of material, are sewed to each other, then the roller 33 would move upwardly until the switch 35 is opened with the switch 186 opening on downward movement of the roller 33. When this occurs, the motor 22 (see FIG. 8) is inactivated so that rotation of the pulley 23 (see FIG. 3) is stopped. This prevents any further operation until the roller 33 (see FIG. 1) returns to its lowermost position in which the switch 186 is closed. The switch 35 closes earlier than the switch 186 since the switch 35 closes when the roller 33 moves downwardly from the position in which the bar 35' opened the switch 35.

When the strip 24 of material ceases to be supplied to the apparatus of the present invention and the end of the strip 24 of material is not held at the sewing machine, the feeding of the end of the strip 24 of material past the meter finger 39 results in the meter finger 39 moving into engagement with the meter plate 38 whereby the switch 188 is opened by the adjustment screw 199. This also inactivates the motor 22 (see FIG. 8) to stop operation of the apparatus of the present invention. If desired, the apparatus of the present invention also could be utilized to respond to the strip 24 of material having a thinner portion, rather than a thicker portion, in the manner shown and described in the aforesaid Schmidt et al patent.

It should be understood that the rotation of the knife frame 58 (see FIG. 12) could be controlled so that the knife frame 58 would be rotated only once during each cycle of operation with rotation occurring after completion of the first cut during each cycle of operation. That is, the knife frame 58 would stay at the position at which the second cut is made during one cycle of operation until the first cut of the next cycle of operation is completed.

An advantage of this invention is that it produces two pointed ends of a belt loop to enable easier sewing at the belt loop. Another advantage of this invention is that forming pointed ends of the cut segment eliminates fraying. A further advantage of this invention is that cut segments which are not within a certain thickness are discarded or rejected.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A material cutting apparatus for cutting a strip of material into segments of a selected length with each segment having pointed ends including:

feed means to feed the strip of material past a cutting location;

cutting means to cut the fed material at the cutting location into the segments;

movably mounting means to movably mount said cutting means for movement between first and second cutting positions at the cutting location;

controlling means controlling said feed means and said cutting means to stop feed of the strip of material by said feed means before said cutting means cuts the strip of material to cut a segment of material and to start feed of the strip of material by said feed means after said cutting means has cut the fed material with said cutting means in each of its first cutting position and its second cutting position at the cutting location so that said cutting means has completed cutting the segment of material;

first activating means to activate said cutting means when said cutting means is in one of its first and second cutting positions to cut the strip of material at a first angle other than orthogonal to its feed path and to activate said cutting means when said cutting means is in the other of its first and second cutting positions to cut the strip of material at a second angle other than orthogonal to its feed path and to the first angle of the cut produced by said cutting means at said one cutting position;

second activating means to move said cutting means between its first and second cutting positions to enable cutting of the strip of material at the first and second angles to form a pointed end;

clamping means to clamp the segment of material to be cut from the strip of material to hold the segment of material in position after it is cut by said cutting means when said cutting means is in said one cutting position;

and clamping control means to render said clamping means effective prior to said cutting means cutting the strip of material a first time when said cutting means is in said one cutting position and to render said clamping means ineffective only after said cutting means has cut the strip of material a second time when said cutting means is in said other cutting position.

2. The apparatus according to claim 1 in which said movably mounting means rotatably mounts said cutting means for rotation between its first cutting position and its second cutting position about an axis of rotation substantially orthogonal to the feed path of the strip of material to be cut.

3. The apparatus according to claim 2 in which:

said cutting means includes:

a frame;

a fixed knife supported by said frame;

and a movable knife supported by said frame for movement relative to said fixed knife;

said movably mounted means includes:

first rotatably supporting means to rotatably support one end of said frame for rotation about the axis of rotation;

and second rotatably supporting means to rotatably support the other end of said frame for rotation about the axis of rotation;

and said first activating means includes movable means to move said movable knife relative to said fixed knife to cut the strip of material.

4. The apparatus according to claim 3 in which said second rotatably supporting means is connected to said movable knife and to said movable means of said first activating means.

5. The apparatus according to claim 4 including:

a rotatable shaft;

a cam mounted on said rotatable shaft for rotation therewith;

and said cam having first means cooperating with said first activating means to control said first activating means, second means cooperating with said second activating means to control said second activating means, and third means cooperating with said clamping control means to control said clamping control means.

6. The apparatus according to claim 5 including:
feed activating means to activate said feed means;
and said controlling means including said feed activating means and said rotatable shaft being driven in unison.

7. The apparatus according to claim 6 in which:
said first means of said cam is a first closed track;
said movable means of said first activating means includes:
a cam follower disposed in said first closed track;
and means to connect said cam follower to said movable knife to control movement of said movable knife towards and away from said fixed knife to cut the strip of material during rotation of said cam;
said second means of said cam is a second closed track;
and said activating means includes:
a cam follower disposed in said second closed track;
and connecting means to connect said cam follower to one of said first and second rotatably supporting means to control rotation of said frame about its axis of rotation during rotation of said cam.

8. The apparatus according to claim 7 in which said connecting means of said second activating means includes means to control the amount of rotation of said frame about its axis of rotation.

9. The apparatus according to claim 6 in which:
said feed means feeds the strip of material in a vertical direction past the cutting location;
and the axis of rotation of said frame of said cutting means is horizontal.

10. The apparatus according to claim 6 including:
means to slidably support said movable knife on said frame;
one of said first and second rotatably supporting means being connected to said movable knife;
and said first activating means including means connected to said one means of said first and second rotatably supporting means to move said movable knife towards said fixed knife while rotatably supporting one of the ends of said frame.

11. The apparatus according to claim 1 in which said clamping means includes:
means disposed on the side of said cutting means remote from said feed means and along the path of travel of the strip of material;
and movable means to move the segment of the strip of material that has been fed past said cutting means into engagement with said disposed means to clamp the segment of material to be cut against said disposed means.

12. The apparatus according to claim 11 in which:
said movable means of said clamping means is rotatable into and out of engagement with said disposed means of said clamping means;
and said clamping control means includes means to rotate said movable means of said clamping means into and out of engagement with said disposed means of said clamping means.

13. The apparatus according to claim 11 in which:
said disposed means of said clamping means includes a substantially flat surface having a pair of fingers extending therefrom substantially orthogonal thereto and disposed to have the strip of material pass therebetween after being fed by said feed means past said cutting means;
said movable means includes a rotatably mounted finger movable into and out of engagement with said flat surface of said disposed means;
and said clamping control means includes means to rotate said finger into and out of engagement with said flat surface of said disposed means.

14. The apparatus according to claim 1 in which:
said feed means feeds the strip of material in a vertical direction past the cutting location;
and said clamping means includes:
means disposed beneath said cutting means and along the path of travel of the strip of material;
and movable means to move the segment of the strip of material that has been fed past said cutting means into engagement with said disposed means to clamp the segment of material to be cut against said disposed means.

15. The apparatus according to claim 14 in which:
said movable means of said clamping means is rotatable into and out of engagement with said disposed means of said clamping means;
and said clamping control means includes means to rotate said movable means of said clamping means into and out of engagement with said disposed means of said clamping means.

16. The apparatus according to claim 14 in which:
said disposed means of said clamping means includes a substantially flat vertical surface having a pair of fingers extending therefrom substantially orthogonal thereto and disposed to have the strip of material pass therebetween after passing beyond said cutting means;
said movable means includes a rotatably mounted finger movable into and out of engagement with said flat vertical surface of said disposed means;
and said clamping control means includes means to rotate said finger into and out of engagement with said flat vertical surface of said disposed means.

* * * * *

UNITED STATES PATENT AND TRADEMARK OFFICE

CERTIFICATE OF CORRECTION

PATENT NO. : 4,462,289

DATED : July 31, 1984

INVENTOR(S) : Volker Schmidt

It is certified that error appears in the above—identified patent and that said Letters Patent is hereby corrected as shown below:

Column 1, line 28, "for" should read --- of ---.

Column 2, line 16, "feed" should read --- fed ---.

Column 3, line 54, after "4" insert a --- comma (,)---

Column 12, line 4, "line" should read --- lines ---.

Column 13, line 27, after "186" insert a --- comma (,) ---.

Column 13, line 28, "line" should read --- lines ---.

Column 13, line 38, "back" should read --- base ---.

Column 14, line 61, "33" should read --- 133 ---.

Column 15, line 16, "201'" should read --- 201° ---.

Column 15, line 38, "346'" should read --- 346° ---.

Column 17, line 41, "at" should read -- of ---.

UNITED STATES PATENT AND TRADEMARK OFFICE

CERTIFICATE OF CORRECTION

PATENT NO. : 4,462,289

DATED : July 31, 1984

INVENTOR(S) : Volker Schmidt

It is certified that error appears in the above—identified patent and that said Letters Patent is hereby corrected as shown below:

Column 18, line 46, "mounted" should read --- mounting ---.

Signed and Sealed this

*Fifteenth* Day of *January 1985*

[SEAL]

*Attest:*

GERALD J. MOSSINGHOFF

*Attesting Officer*

*Commissioner of Patents and Trademarks*